United States Patent [19]

Franzen et al.

[11] 4,356,008

[45] Oct. 26, 1982

[54] KNOCKING ARRANGEMENT FOR ELECTRIC PRECIPITATION

[75] Inventors: Rudolf Franzen; Peter Klingberg, both of Cologne, Fed. Rep. of Germany

[73] Assignee: Buckau-Walther AG, Grevenbroich, Fed. Rep. of Germany

[21] Appl. No.: 323,910

[22] Filed: Nov. 23, 1981

[30] Foreign Application Priority Data

Nov. 22, 1980 [DE] Fed. Rep. of Germany ..... 3044018

[51] Int. Cl.[3] ..... B03C 3/76

[52] U.S. Cl. ..... 55/112; 173/98; 173/101; 173/132; 403/49; 72/481

[58] Field of Search ..... 55/112, 300; 72/481; 403/49; 173/132, 98, 101

[56] References Cited

U.S. PATENT DOCUMENTS 3,844,742 10/1974 Peterson ..... 55/112

4,263,022 4/1981 Brandt et al. ..... 55/112

FOREIGN PATENT DOCUMENTS 718169 2/1980 U.S.S.R. ..... 55/112

*Primary Examiner*—Bernard Nozick

*Attorney, Agent, or Firm*—Michael J. Striker

[57] ABSTRACT

A knocking arrangement for cleaning electrodes of an electric precipitator has a plurality of hammer members mounted on a rotary shaft, a plurality of anvil members arranged so that the hammer members strike against the anvil members, and connecting elements including a V-shaped holding member with a closed end portion embracing one frame member of a frame of the precipitator, and an open end portion provided with two projections, wherein a wedge member carrying the anvil member is received into the holding member between the projections and the one frame member.

10 Claims, 5 Drawing Figures

KNOCKING ARRANGEMENT FOR ELECTRIC PRECIPITATION

BACKGROUND OF THE INVENTION

The present invention relates to a knocking arrangement for an electric precipitator or dust collector.

Knocking arrangements for cleaning spark (corona-discharge) electrodes mounted on frame members of a frame of an electric percipitator are known in the art. A known knocking arrangement is arranged in a collecting chamber of the electric precipitator and has a plurality of knocking hammers mounted on a shaft driven from outside the collecting chamber, and a plurality of anvils each having an anvil plate with a shaft mounted by a holder on the respective frame member. In the process of electrostatic collection of for example dust from a gaseous medium, the gaseous medium is guided through an electrical field of an electrical dust collector, so that the dust deposits on the electrodes of the collector because of precipitation. One of the knocking arrangements for cleaning these electrodes is described, for example, in the Walther brochure D 12 3135/0502. In this arrangement the holder of the anvil is composed of clamping pieces which are clamped by screws on an anvil shaft, and at the same time the holder is mounted on the frame of the electrodes. The clamping screwing with a clamping action transverse to the striking direction of the knocking arrangement possesses several disadvantages. Because of the striking action, the screw connection becomes loose after a short time of operation, so that the anvils turn about the axis of the frame members and thereby no engaging face for the hammer is available. The hammer strikes outside of the anvil plate and acts upon the anvil shaft, which leads to damage to the anvil. Moreover, the knocking action proper is reduced and in part completely excluded. When the screw connection is loosened completely, the anvil falls into a dust container and damages the transporting means located in the latter for transporting the collected dust. In the event of partial loosening of the screw connection, the anvil holder does not completely abut against the frame member, which leads to a wedge action on the frame member and thereby to damage to the same.

SUMMARY OF THE INVENTION

Accordingly, it is an object of the present invention to provide a knocking arrangement for cleaning electrodes of an electric precipitator, which avoids the disadvantages of the prior art.

More particularly, it is an object of the present invention to provide a knocking arrangement for cleaning electrodes of an electric precipitator which guarantees effective cleaning without causing damage to parts of the arrangement and precipitator, and at the same time has a short time for its mounting.

In keeping with these objects and with others which will become apparent hereinafter, one feature of the present invention resides, briefly stated in a knocking arrangement which has an anvil holding element formed as a V-shaped member with a closed end portion lying on the frame member and an open end portion provided with two projections, and a wedge member of each anvil is inserted into the interior of the holder between the end projections and the frame member of the precipitator.

With the arrangement of the present invention, the holding element is inserted from inside at the height of the respective hammer member through the outer frame member of the precipitator frame, and the wedge member is inserted between the frame member and the projections of the holder, the wedge member carrying the anvil member, or more particularly an anvil shaft with an anvil plate. Since the wedge member abuts parallel on the frame member, a linear surface contact of the wedge on the frame member takes place whereas the wedge-shaped outer surface of the wedge applies a pressing action against the projections transverse to the longitudinal axis of the frame member.

The construction also makes possible mounting of the knocking arrangement in a very short time, inasmuch as the arrangement utilizes parts which are loosely clamped relative to one another. This loosening of the holding members can be prevented in a simple way by forming the projections wedge-shaped and forming the outer faces of the wedge members in correspondence with the latter, wherein the inner faces of the wedge members are parallel to the frame member.

The holding action can be further improved when one lateral face of the holding member has a slot-shaped recess with an extension provided in the region of its closed end and lying on a transverse frame member of the electrode frame. The holding member lies on the transverse frame member and cannot be displaced downwardly. Because of the knocking action, the wedge member oscillates to such an extent into the space between the frame member and the projections of the holding member that at any time a sufficient mounting of the holding member is guaranteed.

The novel features which are considered characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
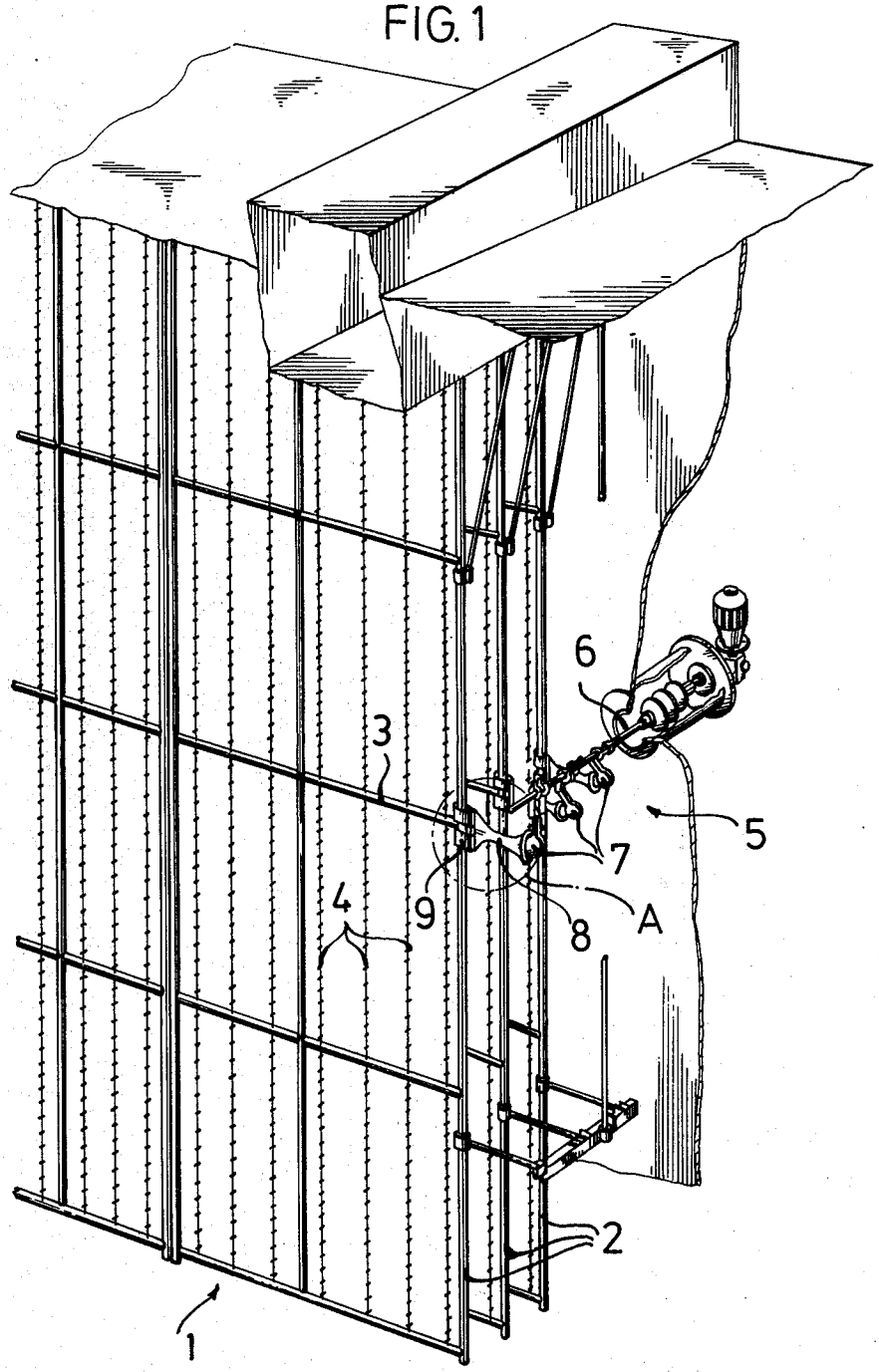
FIG. 1 is a schematic view showing an electrode frame of an electric precipitator with a knocking arrangement in accordance with the invention.
Figure 2:
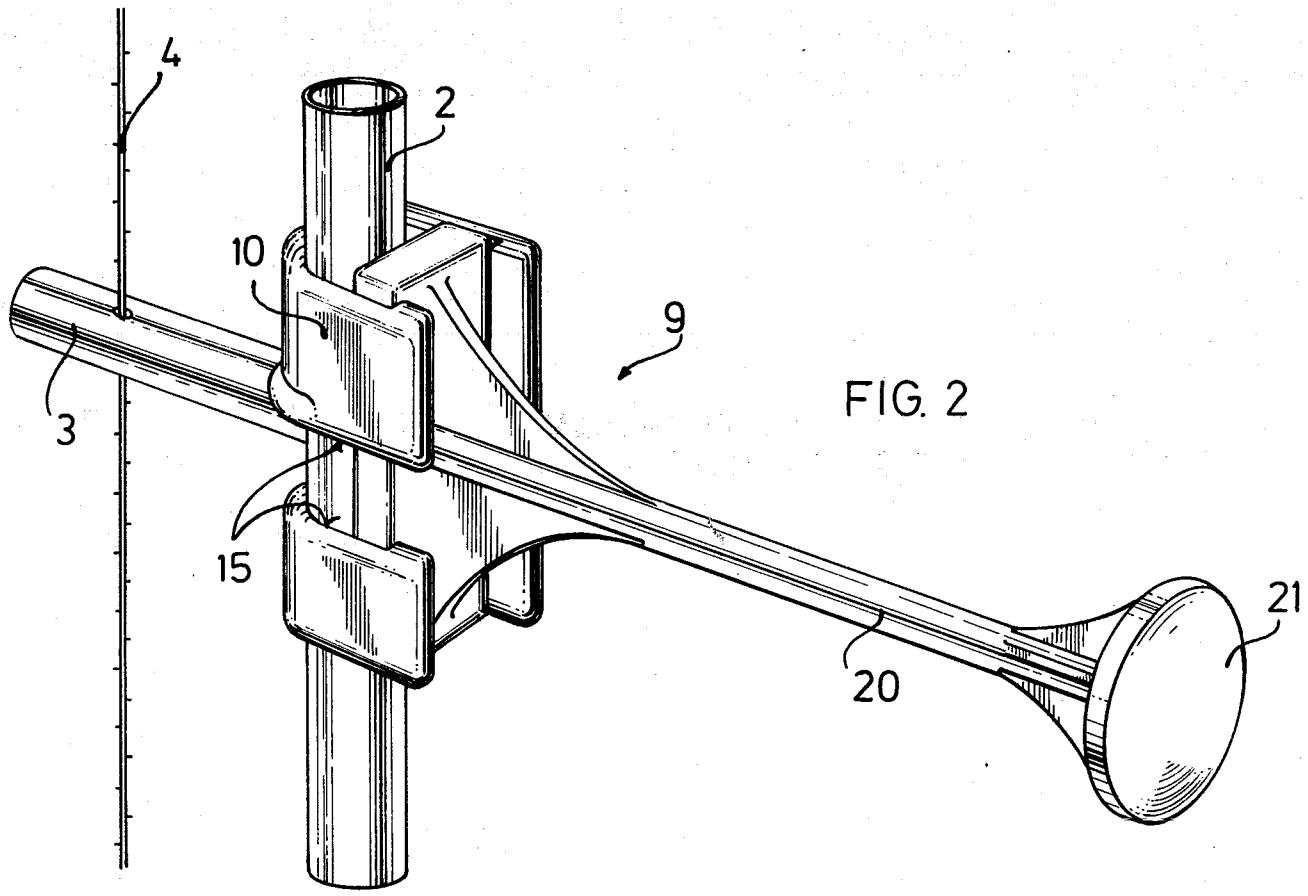
FIG. 2 is a view showing an area A in FIG. 1 on an enlarged scale.
Figure 3:
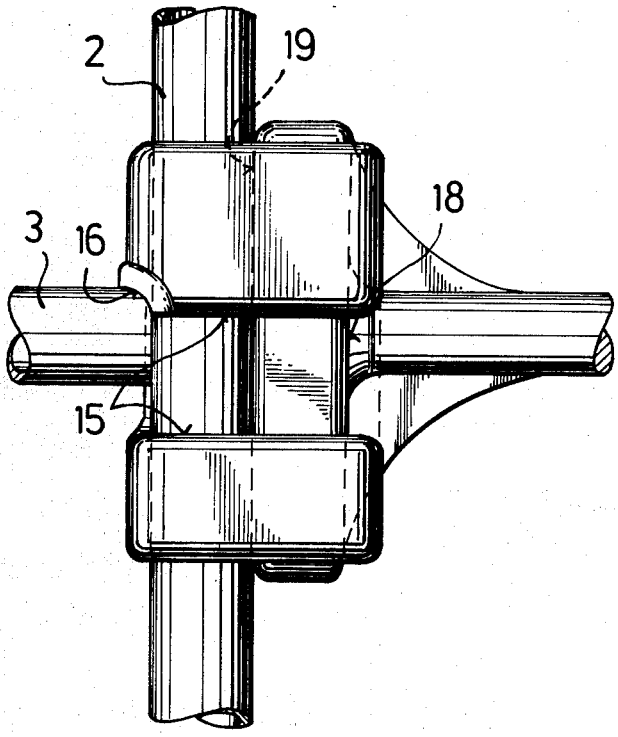
FIG. 3 is a lateral view of a holding member for an anvil member.
Figure 5:
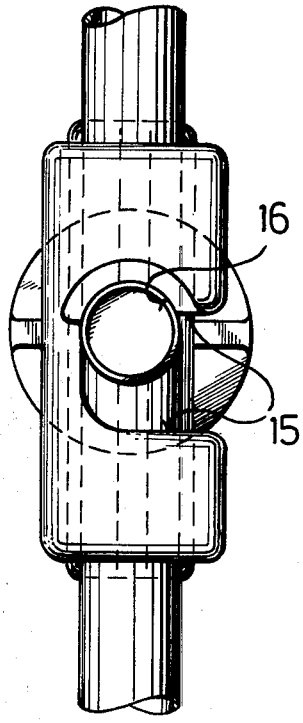
FIG. 5 is a front view of the holding member of FIG. 3.
Figure 4:
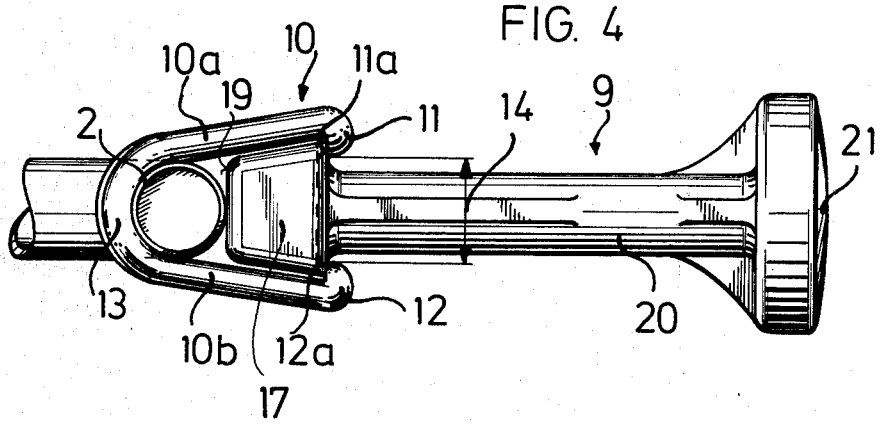
FIG. 4 is a plan view of the holding member of FIG. 3.

A knocking arrangement in accordance with the invention is utilized for cleaning spark (corona-discharge) electrodes 4 of an electric precipitator (dust collector). The precipitator has frames 1 including a frame tubular member 2 with transverse members 3. The electrodes 4 are mounted on the upper and lower tubular members. The transverse members 3 can be provided with throughgoing openings or other mounting means for the electrodes 4.

A knocking arrangement is identified in toto by reference numeral 5 and arranged in the shown example at the height of the transverse member 3. The knocking arrangement has a shaft 6 provided with a drive which is arranged outside of a collecting chamber and carries a plurality of knocking hammers 7. Each hammer 7 acts upon an anvil 8 mounted on the respective tubular member 2. The anvil 8 has, for example, an anvil-holding member 9 formed as a V-like shaped member 10 with lateral faces 10*a* and 10*b*. The shaped member 10 has at its open end projections 11 and 12 forming inner faces 11*a* and 12*a*. A closed end 13 of the shaped member 10 has a shape substantially corresponding to the shape of the tubular member 10 of the frame 1, so that the closed end lies with its inner face on the tubular member 2. More particularly, the tubular member 2 and the inner end 13 of the shaped member 10 can be rounded.

The projections 11 and 12 of the shaped member 10 are spaced from one another by a distance 14 which substantially corresponds to the diameter of the tubular member 2, so that the shaped member 10 can be displaced over the tubular member 2. One of the lateral faces 10*a* and 10*b* is provided with a slot-shaped recess 15, and thereby the holding member 10 can be placed through the transverse member 3 and the tubular member 2 of the frame. The slot-shaped recess 15 has a depression 16 in the region of the closed end 13 for fixed abutment of the holding member 9 against the transverse member 3.

The inner faces 11*a* and 12*a* of the projections 11 and 12 extend from above downwardly in a wedge-shaped manner, so that the distance between the projections and the tubular member 2 narrows from above downwardly. A space is formed outwardly of the frame 11 and between the tubular member 2 and the inner faces 11*a* and 12*a*. A wedge member 17, which carries an anvil plate 21 via an anvil shaft 20, is inserted into the above mentioned space. The wedge member 17 has an outer face which is similarly wedge-shaped and corresponds to the inner faces 11*a* and 12*a* of the projections 11 and 12. An inner face 19 of the wedge member 17 extends parallel to the longitudinal axis of the tubular member 2 and normal to the anvil shaft 20.

The wedge member 17, which is firmly pressed between the tubular member 2 and the inner faces 11*a* and 12*a* of the holding member 9, serves for reliable mounting of the holding member 9 on the frame 11. The wedge action of the projections 11 and 12 with the wedge member 17 in connection with the recess 15 serves for fixing the holding member 9 in the longitudinal direction of the tubular element 2. The depression 16 in the shaped member 10 serves for preventing the rotation of the holding member 9 about the axis of the tubular member 2.

It will be understood that each of the elements described above, or two or more together, may also find a useful application in other types of constructions differing from the types described above.

While the invention has been illustrated and described as embodied in a knocking arrangement for cleaning electrodes of an electric precipitator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A knocking arrangement for cleaning electrodes arranged on frame members of a frame of an electric precipitator, comprising hammer means including a rotary hammer shaft and a plurality of hammer members mounted thereon; anvil means including a plurality of anvils arranged so that said hammer members strike against said anvil members; and means for connecting said anvil members with the frame members, said connecting means including a V-shaped holding member having a closed end portion arranged to embrace one frame member of the frame of the precipitator and an open end portion provided with two projections, and a wedge member carrying a respective one of said anvil members and also received into said holding member between said projections and the one frame member.

2. A knocking arrangement as defined in claim 1, wherein each of said anvil members has an anvil plate and an anvil shaft connected with said anvil plate and with said wedge member, said anvil plate, anvil shaft and wedge member being of one piece with one another.

3. A knocking arrangement as defined in claim 1; and further comprising drive means arranged for driving said rotary hammer shaft and located outside of a collecting chamber of the precipitator.

4. A knocking arrangement as defined in claim 1, wherein each of the frame members of the frame of the precipitator are tubular, said closed end portion of each of said holding members has a round shape substantially corresponding to the shape of the tubular frame member so as to abut against the latter.

5. A knocking arrangement as defined in claim 1, wherein said projections have inclined faces facing toward said wedge members, each of said wedge members having an outer face which is also inclined correspondingly, and an inner face which is parallel to the respective frame member.

6. A knocking arrangement as defined in claim 1, wherein the frame members have a predetermined diameter, said projections of said holding member being spaced from one another by a distance substantially corresponding to the diameter of the frame members.

7. A knocking arrangement as defined in claim 1, wherein said holding member of said connecting means has a plurality of edges, all said edges of said holding member being rounded.

8. A knocking arrangement as defined in claim 1, wherein said V-shaped holding member of said connecting means has two lateral faces one of which has a slot-shaped recess.

9. A knocking arrangement as defined in claim 1, wherein one frame member is a longitudinal member, the frame members of the frame of the precipitator also including transverse frame members, said holding member of said connecting means having means for resting on the respective transverse member of the frame.

10. A knocking arrangement as defined in claim 9, wherein said resting means includes an extension of said recess of each of said holding members, said extension of said recess being provided in the region of said closed end portion of each of said holding members.

* * * * *